US005588744A

United States Patent [19]

Lucas et al.

[11] Patent Number: 5,588,744

[45] Date of Patent: Dec. 31, 1996

[54] GALLERY RING ASSEMBLIES FOR CHANDELIERS

[75] Inventors: John M. Lucas, Cadyville; Arnold Schonbek; Georg Bayer, both of Plattsburgh, all of N.Y.

[73] Assignee: Schoenbek Worldwide Lighting, Inc., Plattsburgh, N.Y.

[21] Appl. No.: 369,384

[22] Filed: Jan. 6, 1995

[51] Int. Cl.[6] ..... F21S 1/06

[52] U.S. Cl. ..... 362/405; 362/806

[58] Field of Search ..... 362/405, 806; D26/72, 152; 228/149, 154; 72/51, 379.2

[56] References Cited

U.S. PATENT DOCUMENTS

| | | | |
|---|---|---|---|
| 2,022,640 | 11/1935 | Ullmann | 72/51 |
| 3,321,945 | 5/1967 | Grate | 72/51 |
| 3,802,239 | 4/1974 | Karmann et al. | 72/51 |
| 5,116,009 | 5/1992 | Bayer | 248/303 |
| 5,255,173 | 10/1993 | Schonbek | 362/405 |

*Primary Examiner*—Denise Gromada
*Assistant Examiner*—Sara Sachie Raab
*Attorney, Agent, or Firm*—Wolf, Greenfield & Sacks, P.C.

[57] ABSTRACT

A gallery ring assembly includes a plurality of decorative members, such as glass leaves, mounted around the periphery of a gallery ring. Each of the glass leaves is mounted to the gallery ring with a single mounting screw. Each glass leaf and each mounting location on the gallery ring are provided with interlocking elements to prevent rotation of the glass leaf about the mounting screw. The interlocking elements preferably include an integral dimple on the gallery ring and an indentation on the outer periphery of the glass leaf. The gallery ring may have a truncated conical shape and may be fabricated by laser cutting an arc-shaped flat blank, and rolling the flat blank into a truncated conical shape.

22 Claims, 6 Drawing Sheets

GALLERY RING ASSEMBLIES FOR CHANDELIERS

FIELD OF THE INVENTION

This invention relates to decorative lighting chandeliers and, more particularly, to gallery ring assemblies for chandeliers.

BACKGROUND OF THE INVENTION

In the early 19th century in France, a style of lighting fixtures was developed to match the current architecture and furnishings, which became known as "Empire Styling". Such lighting fixtures were pear shaped and were ornamented with chains made of cut rock crystal or cut glass ornaments. A metal ring to which the chains were attached supported a plurality of candle supporting arms. Near the end of the 19th century, the candle supporting arms were replaced with incandescent bulbs installed on the inside of the pear-shaped configuration.

Manufacturers in the northern part of Bohemia popularized and perfected the construction of such lighting fixtures by using techniques unknown to the manufacturers in early 19th century France. Glass in the shape of leaves was molded and attached to the chain and prism supporting metal rings, known as gallery rings. Such leaf-shaped glass parts became an indispensable part of this type of lighting fixture.

The prior art glass leaf included a single mounting hole and was mounted to the gallery ring with the largest part of the glass leaf extending upwardly from the gallery ring. The drawback of this configuration was that the glass leaves tended to tilt and/or rotate about the single mounting screw, thereby causing the chandelier to have an unattractive appearance. To fasten the glass leaves using force was not practical, since breakage would be unavoidable. Thus, the glass leaves were mounted to the gallery ring with little or no space between them, so that each glass leaf was prevented by adjacent glass leaves from rotating about the mounting screw. This approach was detrimental to the appearance of the fixture and added to its cost, since a large number of glass leaves was required.

When the gallery ring is visible in the finished chandelier, it must have an attractive appearance. In addition, the gallery ring should be easy to manufacture and low in cost.

SUMMARY OF THE INVENTION

According to the present invention a gallery ring assembly for a decorative lighting chandelier is provided. The gallery ring assembly comprises a plurality of decorative members, each having a mounting hole, and a gallery ring having a plurality of locations for mounting the decorative members. Each of the mounting locations includes a mounting hole. Each of the decorative members is secured to the gallery ring by a mounting screw that passes through the mounting hole in the decorative member and the mounting hole in the gallery ring. Each of the decorative members and each of the mounting locations on the gallery ring have interlocking elements to prevent rotation of the decorative member about the mounting screw relative to the gallery ring. Each of the decorative members preferably comprises a glass leaf.

The interlocking elements may comprise a recess in the decorative member and a projection on the gallery ring. The projection engages the recess when the decorative member is mounted to the gallery ring. In a preferred embodiment, the recess comprises an indentation in the outer periphery of the decorative member. The projection at each of the mounting locations of the gallery ring may comprise a metal pin or an integral dimple on the gallery ring.

The interlocking elements secure the glass leaves to the gallery ring in an upright position. The gallery ring may have a decorative appearance, with the glass leaves mounted at spaced-apart locations around its periphery.

According to another aspect of the invention, a gallery ring for a decorative lighting chandelier comprises a metal strip formed into an arcuate ring. The upper and lower side edges of the metal strip have different diameters, so that the arcuate ring has a truncated conical shape. The gallery ring may form a full circle and with its ends connected together, or may form a portion of a full circle.

According to a further aspect of the invention, a method for making a gallery ring for a decorative lighting chandelier is provided. The method comprises the steps of cutting an arc-shaped flat blank from a metal sheet, and rolling the flat blank into an arcuate ring having a truncated conical shape with different diameters on opposite side edges. The arc-shaped flat blank is preferably cut with a metal cutting laser. The method may further include formation of integral dimples used to

BRIEF DESCRIPTION OF THE DRAWINGS

For a better understanding of the present invention, reference is made to the accompanying drawings, which are incorporated herein by reference and in which.

DETAILED DESCRIPTION

Figure 1:
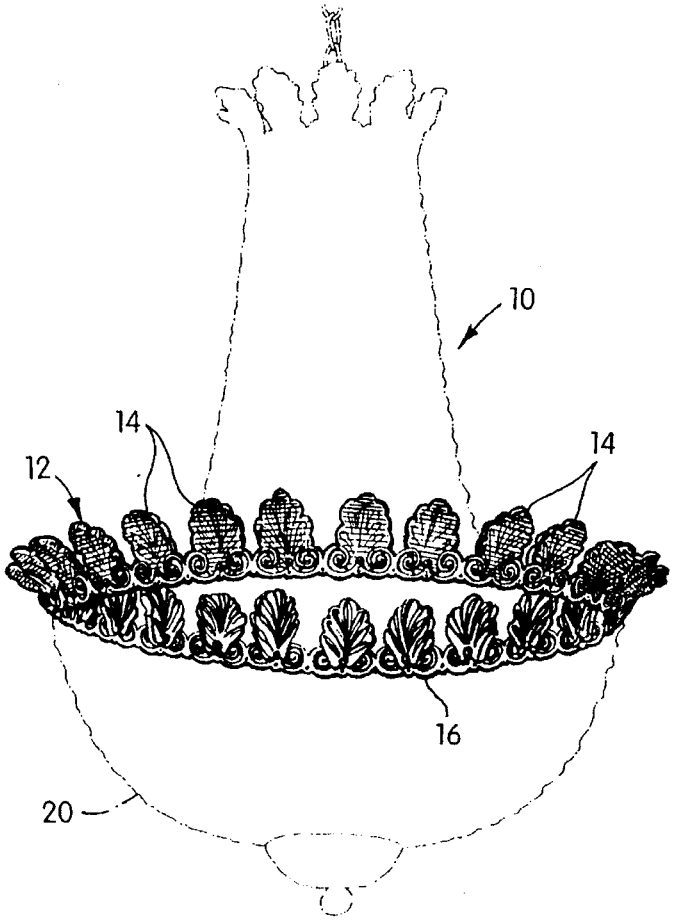
FIG. 1 illustrates a chandelier, partially in phantom, including a gallery ring assembly in accordance with the present invention.

A decorative lighting chandelier 10 incorporating an example of a gallery ring assembly in accordance with the present invention is shown in FIG. 1. The chandelier 10 is of the Empire style. A gallery ring assembly 12 includes a plurality of glass leaves 14 mounted to and spaced around the circumference of a gallery ring 16. The gallery ring 16 may be attached to the chandelier by spokes that extend to a central pipe (not shown) of the chandelier. Crystal chains 20 extend from the gallery ring 16 to a disk located at the lower portion of the chandelier.

Figure 4:
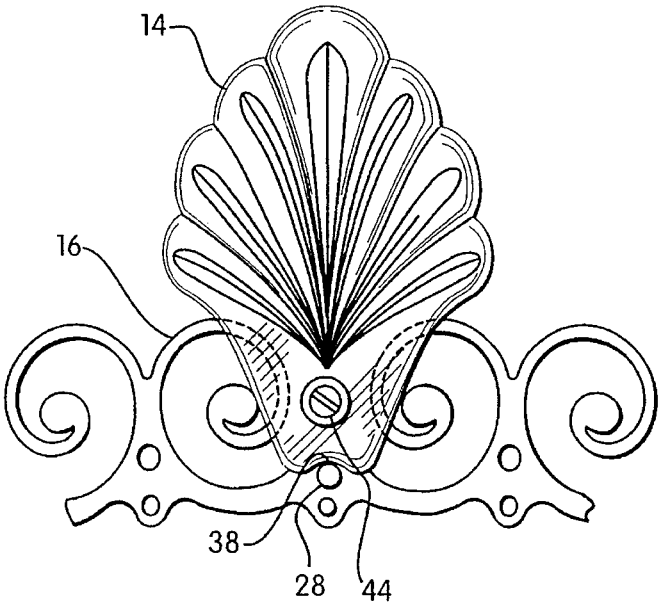
FIG. 4 shows the mounting of a glass leaf on the gallery ring.
Figure 2:
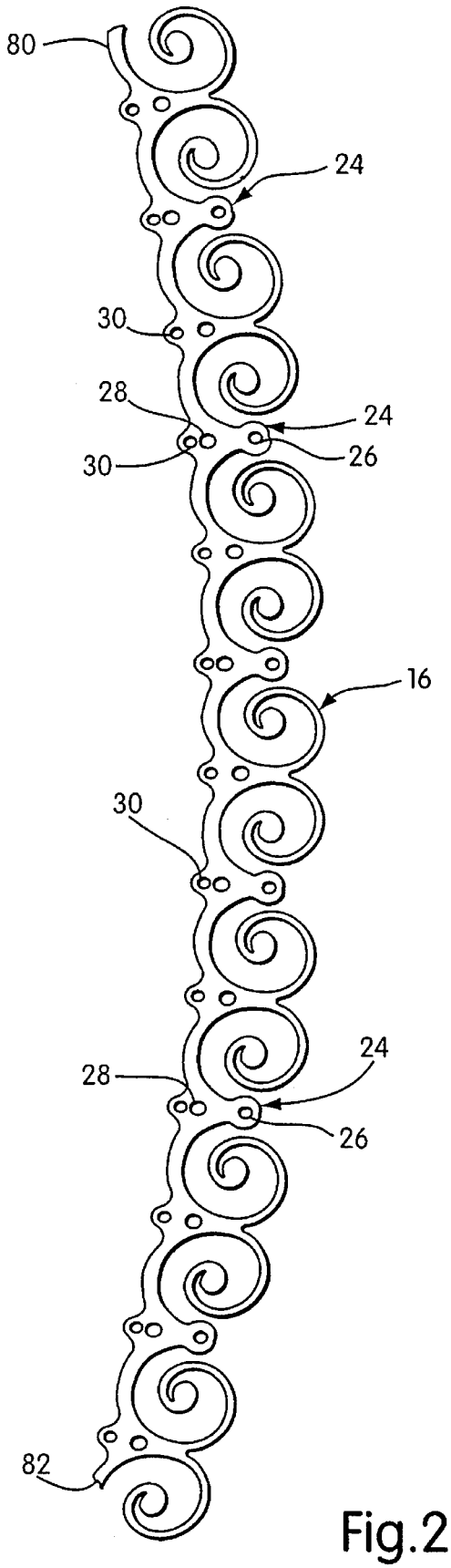
FIG. 2 illustrates a blank used to make the gallery ring shown in FIG.
Figure 3:
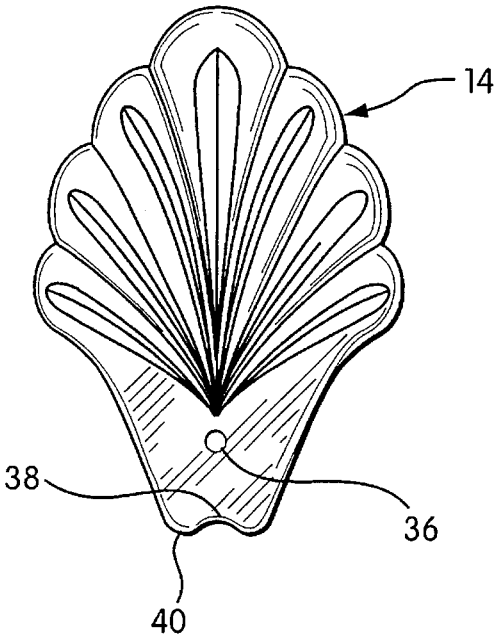
FIG. 3 illustrates a glass leaf used in the chandelier of FIG. 1.
Figure 6:
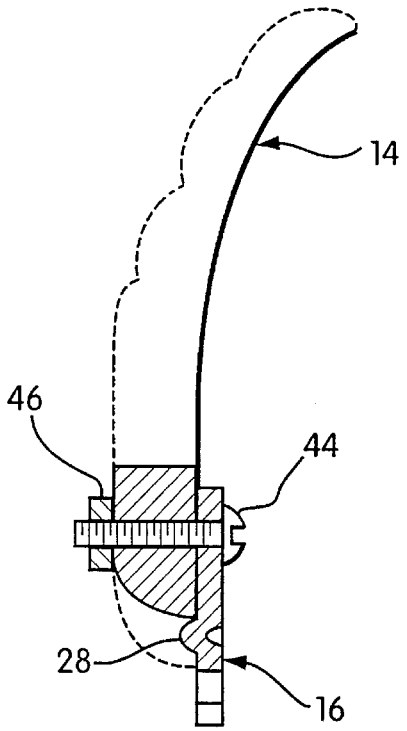
FIG. 6 is a cross-sectional view of the glass leaf mounted to the gallery ring.
Figure 5:
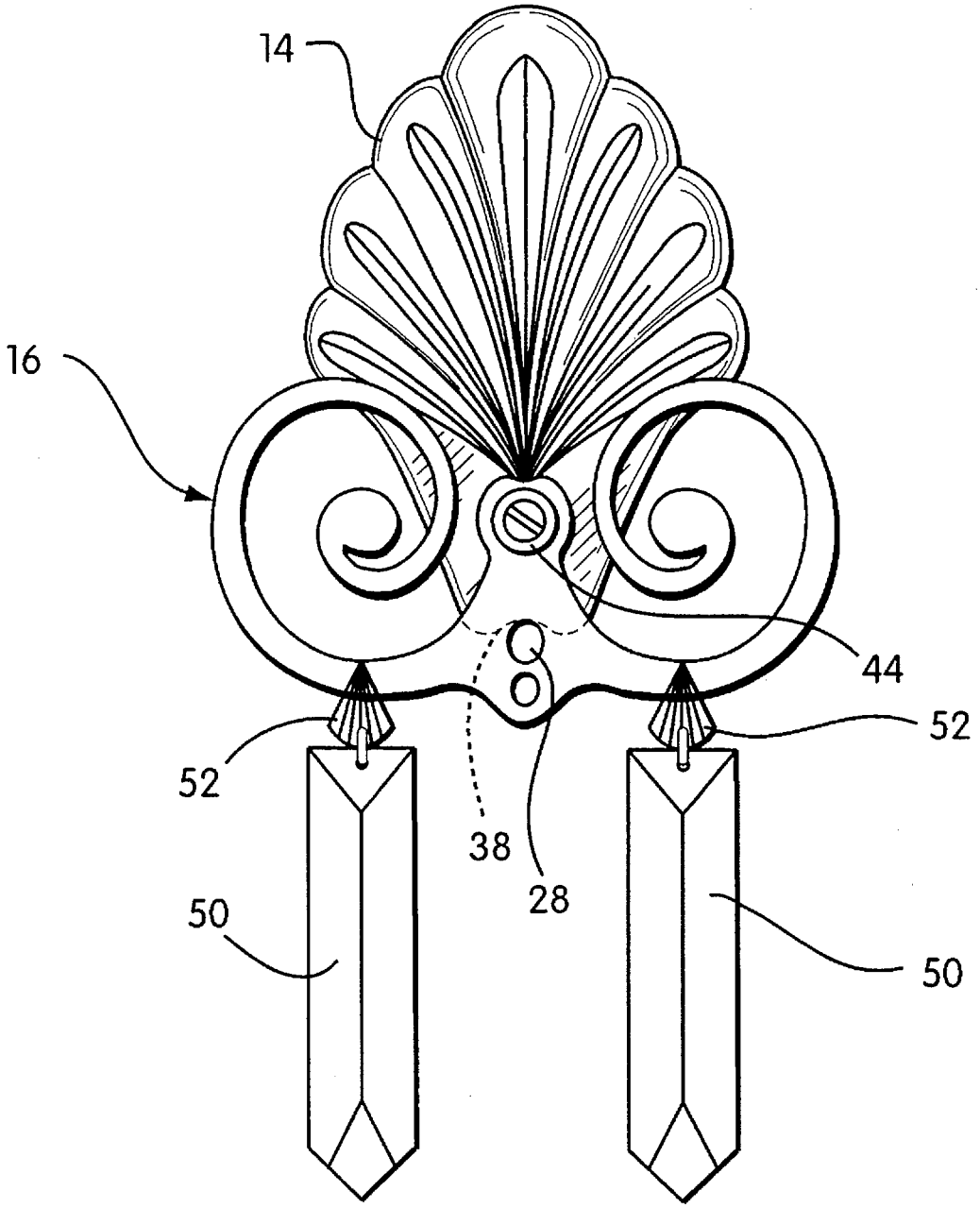
FIG. 5 illustrates a glass leaf and crystal prisms attached to a gallery ring.

A flat blank used to make the gallery ring 16 is shown in FIG. 2. One of the glass leaves 14 is shown in FIG. 3. The mounting of the glass leaf 14 to gallery ring 16 is shown in FIGS. 4–6.

The gallery ring 16 is preferably fabricated from sheet metal such as steel and may have a decorative design. The metal is formed into a circular configuration, which may be cylindrical or truncated conical depending on the desired appearance. The gallery ring 16 includes a plurality of mounting locations 24 for mounting of the glass leaves 14. Each of the mounting locations 24 includes a mounting hole 26 and an interlocking element 28. In the example of FIGS. 2–6, the interlocking element 28 is a pin, dimple or projection that extends outwardly from the surface of the gallery ring 16, for example by a distance of about 0.050 inch. In a preferred embodiment, the interlocking element 28 comprises an integral dimple. The gallery ring 16 further includes holes 30 for attachment of crystal chains 20. A preferred method for fabrication of the gallery ring 16 is described below.

As shown in FIG. 3, glass leaf 14 includes a design that resembles a leaf. A mounting hole 36 is centrally located in the lower portion of glass leaf 14. The outer periphery of glass leaf 14 is formed with a recess 38 or indentation that extends inwardly toward mounting hole 36. In the example of FIG. 3, the recess 38 is located at the bottom of glass leaf 14. The recess 38 can be generally V-shaped, as best shown in FIG. 4, but is not limited as to shape. As shown in FIG. 3, recess 38 defines lobes 40 in the periphery of glass leaf 14. The glass leaf 14 may be formed by molding.

The recess 38 in the glass leaf 14 constitutes an interlocking element for engagement with interlocking element 28 of gallery ring 16, as described below. The distance between recess 38 and mounting hole 36 of glass leaf 14 is approximately the same as the distance between interlocking element 28 and mounting hole 26 of gallery ring 16 to ensure engagement between The interlocking elements.

As shown in FIGS. 4–6, glass leaf 14 is secured to gallery ring 16 by appropriate mounting hardware, typically a mounting screw 44 and a nut 46. The mounting screw 44 extends through mounting hole 26 in gallery ring 16 and mounting hole 36 in glass leaf 14 to secure the glass leaf 14 in an upright position. The projection on gallery ring 16 engages the recess 38 in glass leaf 14 so that the glass leaf 14 is prevented by lobes 40 from rotating about mounting screw 44 relative to gallery ring 16.

In the embodiment of FIGS. 2–6, the gallery ring 16 has a double scroll ornamentation. An optional curtain of crystal prisms 50 may be suspended from the gallery ring 16 as shown in FIG. 5. The prisms 50 are attached to gallery ring 16 by hooks 52, which slide to the lowest points in the double scroll ornamentation of gallery ring 16.

As shown and described above, interlocking elements on the gallery ring 16 and the glass leaf 14 prevent rotation of glass leaf 14 about mounting screw 44 relative to gallery ring 16. The interlocking elements are illustrated as a projection on gallery ring 16 and a recess 38 in the outer periphery of glass leaf 14. This configuration has been found to provide an attractive appearance. It will be understood that different configurations of interlocking elements may be used within the scope of the present invention. For example, the glass leaf 14 may be provided with a hole in the surface that abuts against gallery ring 16, rather than a peripheral recess or indentation for engaging the projection on gallery ring 16. Alternatively, the glass leaf 14 may be provided with a projection that engages a hole or recess in gallery ring 16. Furthermore, the interlocking elements may be located at any convenient positions on the glass leaf 14 and the gallery ring 16. In another approach, the glass leaf and the gallery ring may be provided with second mounting holes which are aligned to accept a second mounting screw that prevents rotation of the glass leaf. Finally, the invention is not limited to glass leaves, but may be applied to any decorative member that is mounted on a gallery ring. The primary requirement is for interlocking elements on the gallery ring and the glass leaf or other decorative member. The interlocking elements engage each other to prevent rotation of the glass leaf when the glass leaf is mounted to gallery ring 16.

Figure 8:
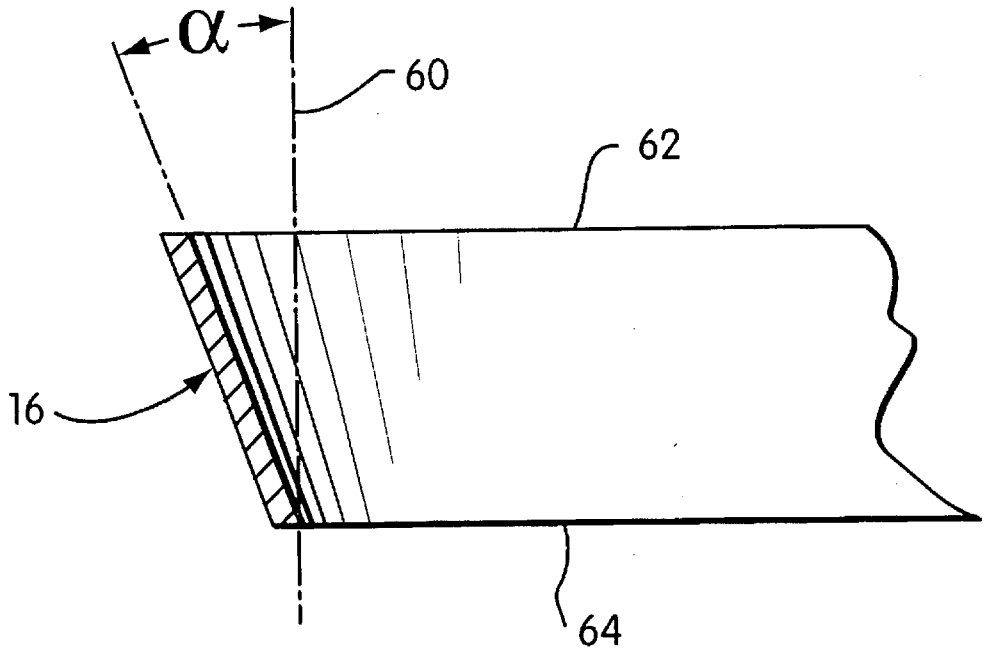
FIG. 8 is a simplified partial cross-sectional view of the gallery ring, illustrating the truncated conical configuration.

The gallery ring 16 is preferably fabricated from a flat blank as illustrated in FIG. 2. The flat blank shown in FIG. 2 is arc-shaped, so that when it is rolled into a gallery ring, the gallery ring will have a truncated conical shape. As illustrated in FIG. 8, the preferred gallery ring 16 preferably comprises a circular metal strip having a cross-section that is angled outwardly at an angle $\alpha$ with respect to a vertical axis 60. In a preferred embodiment, the angle $\alpha$ is about 6°. The ornamentation of the gallery ring 16 has been omitted from FIG. 8 for ease of understanding. As can be seen from FIG. 8, the diameter of the gallery ring at upper edge 62 is larger than the diameter of the gallery ring at a lower edge 64. Thus, an arc-shaped flat blank is required to form the truncated conical gallery ring.

Figure 7:
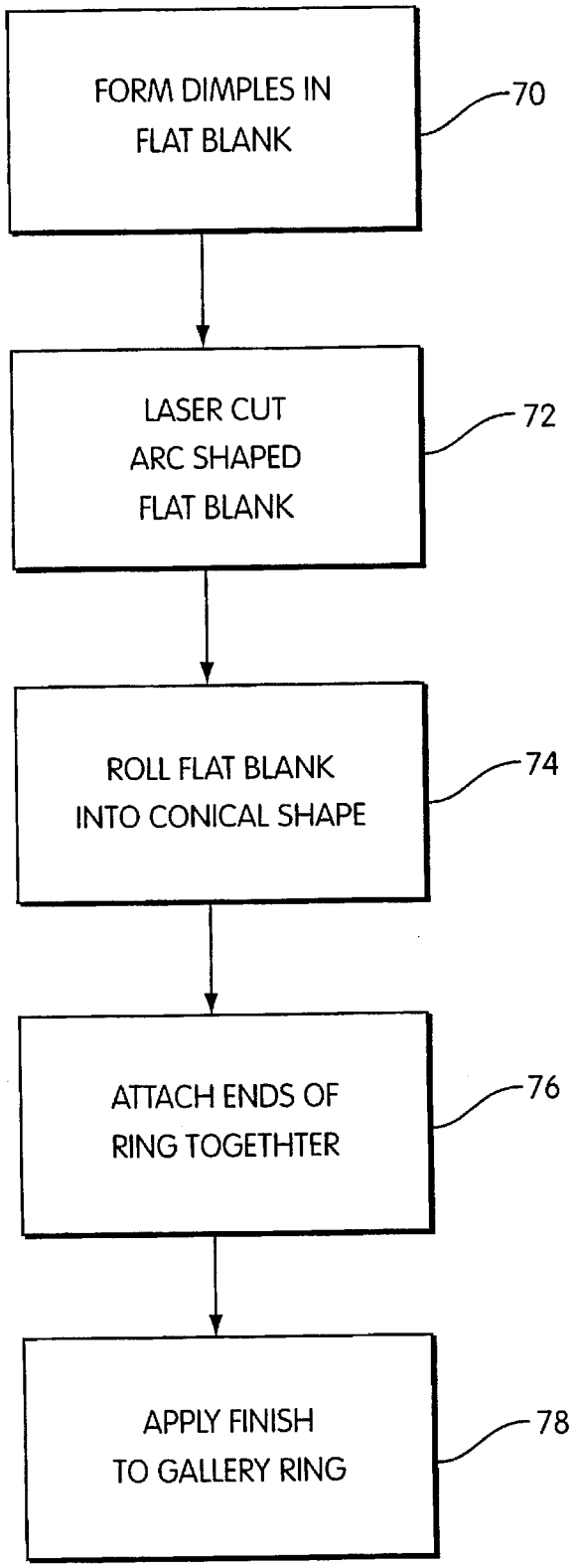
FIG. 7 is a flow diagram that illustrates a method of making the gallery ring.

A preferred method for fabrication of the truncated conical gallery ring is described with reference to the flow diagram of FIG. 7. The gallery ring may, for example, be formed from sheet metal, such as steel, having a thickness of 0.074 inch. If projections 28 are required to prevent rotation of glass leaves 14, they are formed in the sheet metal using a punch press in step 70. Then the arc-shaped flat blank is cut from the sheet metal using a metal cutting laser in step 72. The laser is used to produce any desired ornamentation of the gallery ring. It will be understood that a number of flat blanks for gallery rings can usually be cut from a single metal sheet. Next, the flat blank as shown in FIG. 2 is rolled into a conical shape using a sheet metal rolling machine in step 74. A typical metal rolling machine includes two bottom rollers and a top roller positioned between the bottom rollers. The top roller is tilted with respect to the bottom rollers in order to obtain a smaller radius on one edge of the gallery ring, thereby producing the truncated conical shape. In order to avoid flattening the projections 28 on the gallery ring 16 during rolling, the top roller preferably has a soft urethane plastic surface. After rolling, ends 80 and 82 (FIG. 2) of the gallery ring 16 are in proximity to each other and can be attached together. Any desired technique can be utilized for attaching ends 80 and 82 of the gallery ring. In a preferred embodiment, the ends are resistance welded together. In other approaches, the ends can be connected together by a screw or rivet, or can be interlocked and welded. Finally, a desired finish is applied to the gallery ring. The finish is selected in accordance with a desired appearance of the chandelier.

The gallery ring 16 has been described as having a full circular configuration. The gallery ring described above can also be used in chandeliers designed for wall mounting. In this case, the gallery ring may comprise a semi-circle or other portion of a circle. It will be understood that the method shown in FIG. 7 and described above, can be utilized to fabricate a semi-circular gallery ring having a truncated conical shape, as illustrated in FIG. 8.

While there have been shown and described what are at the present considered the preferred embodiments of the present invention, it will be obvious to those skilled in the art that various changes and modifications may be made therein without departing from the scope of the invention as defined by the appended claims.

What is claimed is:

1. A gallery ring assembly for a decorative lighting chandelier, comprising:

a plurality of decorative members, each having a mounting hole; and a gallery ring having a plurality of locations for mounting said decorative members, each of said mounting locations including a mounting hole, each of said decorative members being secured to said gallery ring by a mounting screw that passes through The mounting hole in said decorative member and the mounting hole in said gallery ring, each of said decorative members and each of the mounting locations on said gallery ring having interlocking elements to prevent rotation of said decorative member about said mounting screw relative to said gallery ring.

2. A gallery ring assembly as defined in claim 1 wherein each of said decorative members comprises a glass leaf and wherein said gallery ring comprises a metal gallery ring.

3. A gallery ring assembly as defined in claim 1 wherein said interlocking elements comprise a recess in said decorative member and a projection on said gallery ring, said projection engaging said recess when said decorative member is mounted to said gallery ring.

4. A gallery ring assembly as defined in claim 3 wherein each of said decorative members has an outer periphery and wherein said recess comprises an indentation in the outer periphery of said decorative member.

5. A gallery ring assembly as defined in claim 3 wherein the projection at each of said mounting locations on said gallery ring comprises a metal pin.

6. A gallery ring assembly as defined in claim 3 wherein the projection at each of said mounting locations on said gallery ring comprises an integral dimple on said gallery ring.

7. A gallery ring assembly as defined in claim 1 wherein said gallery ring has a decorative appearance.

8. A gallery ring assembly as defined in claim 2 wherein each of said glass leaves has a center of gravity that is located above the mounting hole of said glass leaf when the gallery ring assembly is mounted in a chandelier.

9. A gallery ring assembly as defined in claim 1 wherein each of said decorative members includes a single mounting hole.

10. A gallery ring assembly for a decorative lighting chandelier, comprising:

a plurality of glass leaves, each having a single mounting hole and a peripheral indentation spaced from said mounting hole by a predetermined distance; and a gallery ring having a plurality of locations for mounting said glass leaves, each of said mounting locations including a mounting hole and a projection spaced therefrom by about said predetermined distance, each of said glass leaves being secured to said gallery ring by a mounting screw that passes through the mounting hole in said glass leaf and the mounting hole in said gallery ring, the projection at each of said mounting locations engaging the indentation in said glass leaf to prevent rotation of said glass leaf about said mounting screw relative to said gallery ring.

11. A gallery ring assembly as defined in claim 10 wherein the projection at each of said mounting locations on said gallery ring comprises an integral dimple on said gallery ring.

12. A gallery ring assembly as defined in claim 10 wherein said gallery ring comprises a metal strip formed into an arcuate ring having a truncated conical shape.

13. A gallery ring assembly as defined in claim 10 wherein the peripheral indentation in each of said glass leaves comprises a generally V-shaped groove located below the mounting hole in said glass leaf.

14. A gallery ring for a decorative lighting chandelier, comprising:

a metal strip formed into an arcuate ring having upper and lower side edges with different diameters, so that the arcuate ring has a truncated conical shape, the metal strip being constructed and arranged for mounting in a chandelier frame and including a plurality of ornament mounting locations; and a plurality of decorative chandelier ornaments having attachment members constructed and arranged to engage the mounting locations wherein the decorative chandelier elements are attached to the arcuate ring in a predetermined alignment relative to each other.

15. A gallery ring as defined in claim 14 wherein said metal strip includes opposing ends and wherein said arcuate ring is formed into a full circle with said ends connected together.

16. A gallery ring as defined in claim 14 wherein said arcuate ring comprises a portion of a full circle.

17. A gallery ring as defined in claim 14 wherein said arcuate ring includes ornamentation.

18. A gallery ring assembly for a decorative lighting chandelier, comprising:

a plurality of individual decorative elements, each having a peripheral indentation;

a gallery ring having a plurality of locations for mounting said individual decorative elements, each of said mounting locations including a respective projection, each of said individual decorative elements being mounted at each of said mounting locations so that said indentation of each of said individual decorative elements engages a respective projection; and a plurality of interengaging attachment members, each passing between each of said individual decorative elements and said gallery ring at each of said mounting locations, respectively, each of said attachment members being spaced from each respective projection and engaging indentation by a predetermined distance wherein rotation of each of said individual decorative elements about said respective attachment member is restrained by an engagement of each respective projection with each respective indentation.

19. A gallery ring assembly as defined in claim 18 wherein the projection of each of said mounting locations on said gallery ring comprises an integral dimple on said gallery ring.

20. A gallery ring assembly as defined in claim 18 wherein said gallery ring comprises a metal strip formed into an arcuate ring having a truncated conical shape.

21. A gallery ring assembly as defined in claim 20 wherein said arcuate ring includes ornamentation.

22. A gallery ring assembly as defined in claim 18 wherein the peripheral indentation in each of said individual decorative elements comprises a generally V-shaped groove located below the attachment member.

* * * * *